US005257953A

United States Patent [19]

Gillis

[11] Patent Number: 5,257,953

[45] Date of Patent: Nov. 2, 1993

[54] WATER SPORTS BOARD CONVERTIBLE BETWEEN KNEEBOARD AND SKIBOARD CONFIGURATIONS

[75] Inventor: Donald B. Gillis, Lake Stevens, Wash.

[73] Assignee: Connelly Skis, Inc., Lynnwood, Wash.

[21] Appl. No.: 930,064

[22] Filed: Aug. 14, 1992

[51] Int. Cl.[5] ..... B63B 35/80

[52] U.S. Cl. ..... 441/74

[58] Field of Search ..... 441/65, 67, 68, 70, 441/74

[56] References Cited

U.S. PATENT DOCUMENTS 4,871,337 10/1989 Harris ..... 441/70

FOREIGN PATENT DOCUMENTS 3329145 3/1985 Fed. Rep. of Germany ..... 441/74

*Primary Examiner*—Jesus D. Sotelo

*Attorney, Agent, or Firm*—Christensen, O'Connor, Johnson & Kindness

[57] ABSTRACT

A water sports device including an elongated baseboard having the approximate outline shape of a kneeboard, one or more foot-restraining members releasably attachable to the board for configuring it to be used as a skiboard, and a kneepad and associated thigh strap releasably attachable to the board for configuring it for use as a kneeboard.

10 Claims, 4 Drawing Sheets

WATER SPORTS BOARD CONVERTIBLE BETWEEN KNEEBOARD AND SKIBOARD CONFIGURATIONS

FIELD OF THE INVENTION

The present invention relates to aquatic sports devices known as kneeboards and skiboards for supporting a user towed behind a boat.

BACKGROUND OF THE INVENTION

Other than water skis, two of the most popular types of water sports devices are skiboards and kneeboards. A skiboard is used like a slalom water ski, but is more similar in outline shape to a narrow surfboard and has foot straps or bindings secured to the upper surface of the board. The user rides the board upright while being towed. See, for example, co-pending U.S. patent application Ser. No. 07/810,817, filed Dec. 19, 1991, titled "Water Skiboard With Rotatable Binding," which is expressly incorporated by reference herein.

Known kneeboards are wider and shorter than skiboards. Rather than supporting a user upright, a kneeboard typically has a resilient pad secured to the upper surface of a baseboard with side-by-side recesses shaped to receive the user's knees and shins. The user rides the kneeboard in a low kneeling position. An adjustable strap is provided for bearing against the top of the user's thighs to hold the user in position while hanging on to a tow rope.

Kneeboards and skiboards currently available are distinct products so that a consumer must choose between the two or purchase both.

SUMMARY OF THE INVENTION

The present invention provides a water sports device including an elongated baseboard having the approximate outline shape of a kneeboard, one or more foot-restraining members releasably attachable to the board for configuring it to be used like a skiboard, and a kneepad and associated thigh strap releasably attachable to the board for configuring it for use as a kneeboard. In the preferred embodiment, the board includes a central track extending lengthwise of the baseboard and adapted to receive fasteners projecting from the kneepad or, with the kneepad removed, fasteners projecting from the foot-restraining members.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
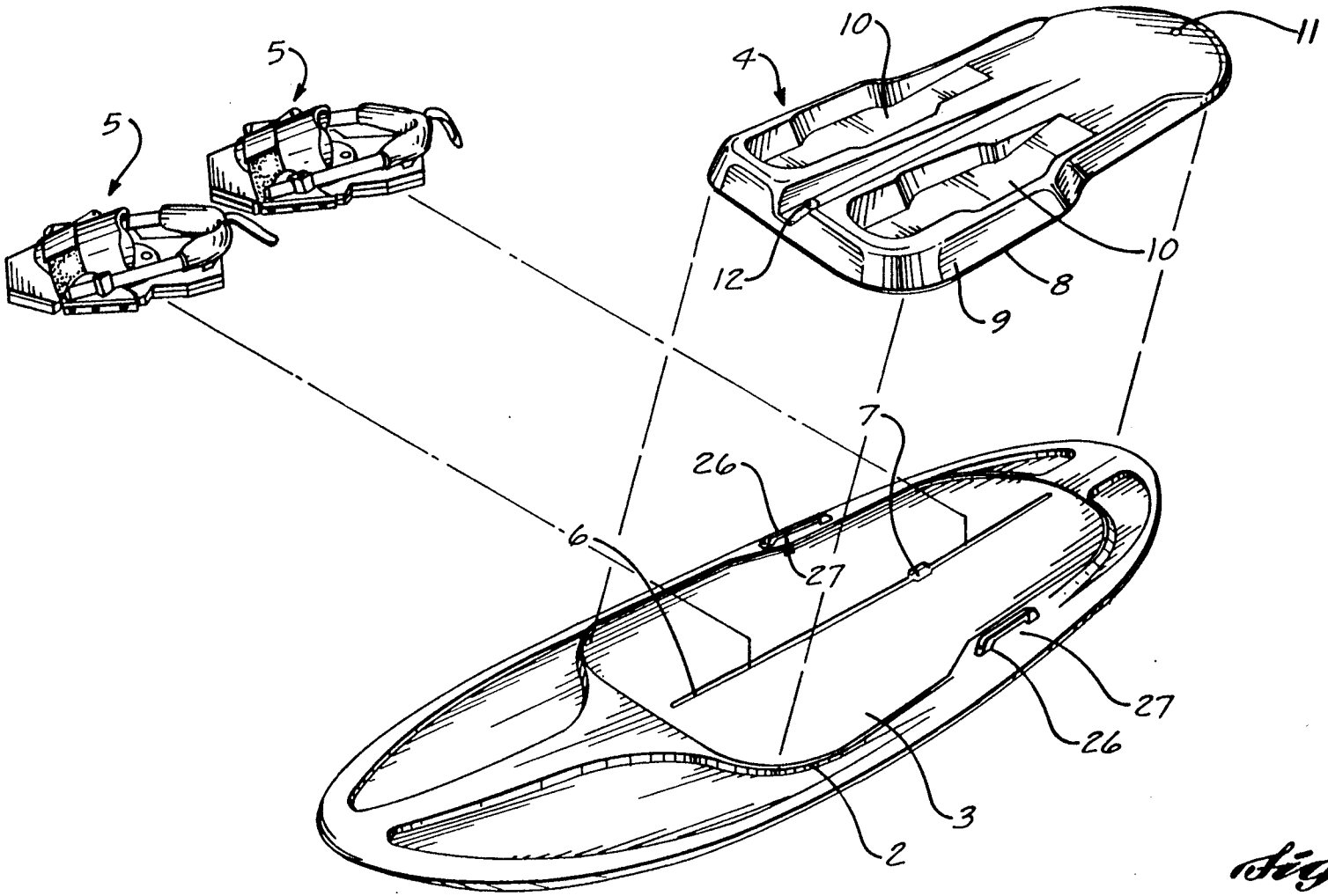
FIG. 1 is a top perspective of a water sports board in accordance with the present invention with parts shown in exploded relationship.

With reference to FIG. 1, the water sports device in accordance with the present invention includes an elongated water-skimming baseboard 1 having an outline shape approximately the same as a conventional kneeboard. Board 1 can be a plastic laminate having a polyethylene outer surface and rigid polyurethane core similar to conventional water sports boards. Preferably the upper surface of the baseboard has an upward-projecting ridge 2 defining a wide oblong top recess 3 having a substantially planar bottom. Recess 3 preferably encompasses the major portion of the width of the board and at least about one-half the length of the board.

A knee pad 4 is detachably connectible to the upper surface of the board for configuring the board as a kneeboard; or, with the pad removed, foot-restraining members such as straps or bindings 5 are detachably connectible to the upper surface of the board so that it can be used like a skiboard. In either case, the pad or foot-restraining members have fasteners that cooperate with fastening mechanism of the board to achieve the desired disconnectable coupling.

In the illustrated embodiment, the baseboard includes a longitudinally extending channel 6 centered in the recess 3. Channel 6 is of inverted T shape with the stem of the T opening through the upper surface of the recessed area of the board. A short, wider opening 7 into the base of the channel is located approximately centrally between the ends of the channel.

Figure 2:
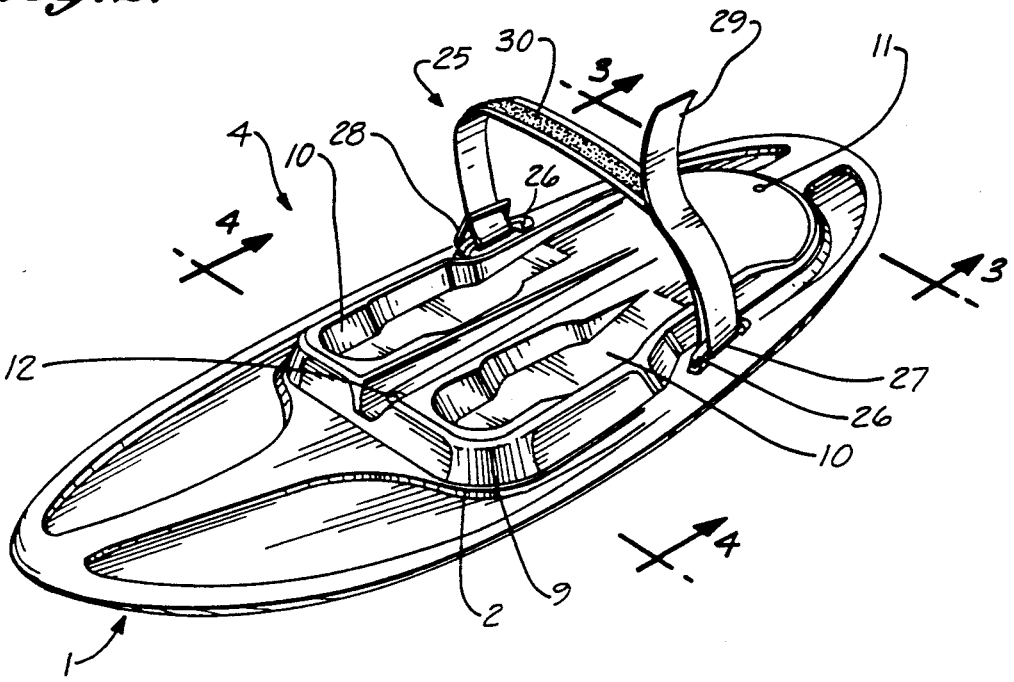
FIG. 2 is a top perspective of the board of FIG. 1 configured as a kneeboard.
Figure 6:
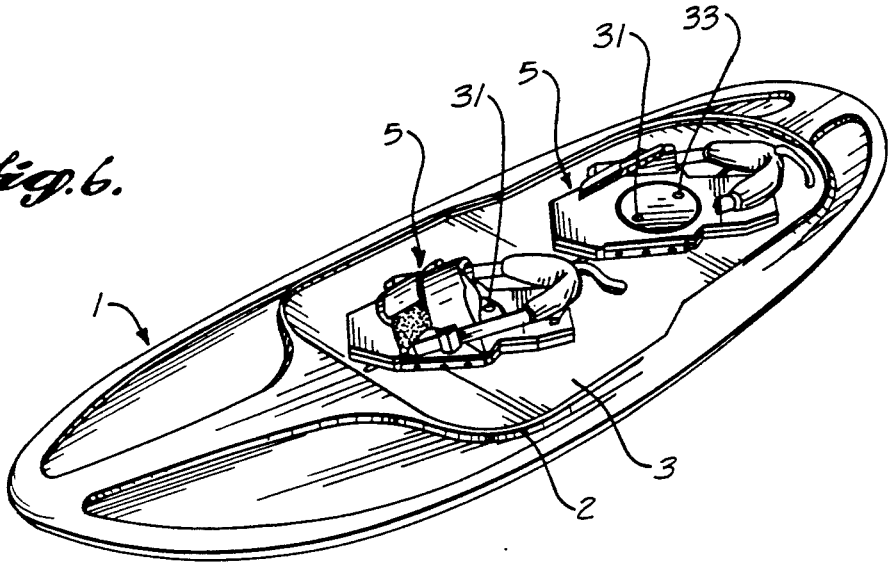
FIG. 6 (on the drawing sheet with FIG. 2) is a top perspective of a water sports board in accordance with the present invention configured as a skiboard.

Preferably knee pad 4 includes a rigid or substantially rigid baseplate 8 having a planar bottom. The baseplate has the same outline shape as the oblong board recess 3 for close fitting of the baseplate in the recess as shown in FIG. 2. An upper resilient cushion 9 with the usual knee and shin recesses 10 is secured to the baseplate.

Figure 3:
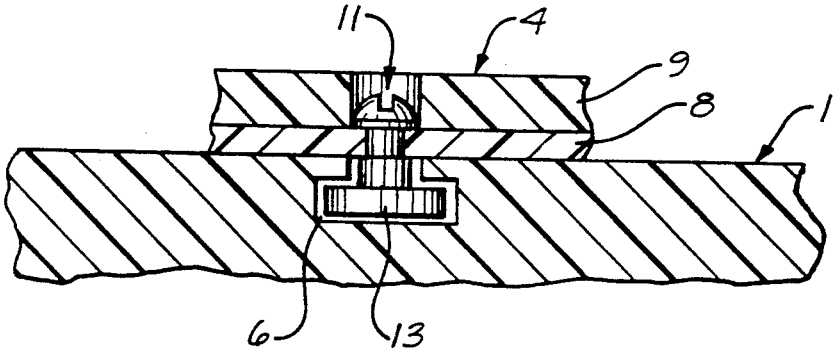
FIG. 3 is an enlarged fragmentary transverse vertical section along line 3—3 of FIG. 2.

In the preferred embodiment shown in the drawings, the composite knee pad 4 has a rear stationary fastener 11 and a front rotatable fastener 12. As shown in FIG. 3, the rear stationary fastener 11 includes a bottom T nut 13 with an enlarged head insertable downward through the channel opening 7 (FIG. 1) when the knee pad 4 is centered on the board but offset forward relative to the recess 3. From such position the knee pad 4 is slidable lengthwise rearward such that head of the T nut of fastener 11 is received in the rear portion of the channel 6 to prevent substantial upward movement of the rear part of the knee pad relative to the board 1, as seen in FIG. 3.

Figure 4:
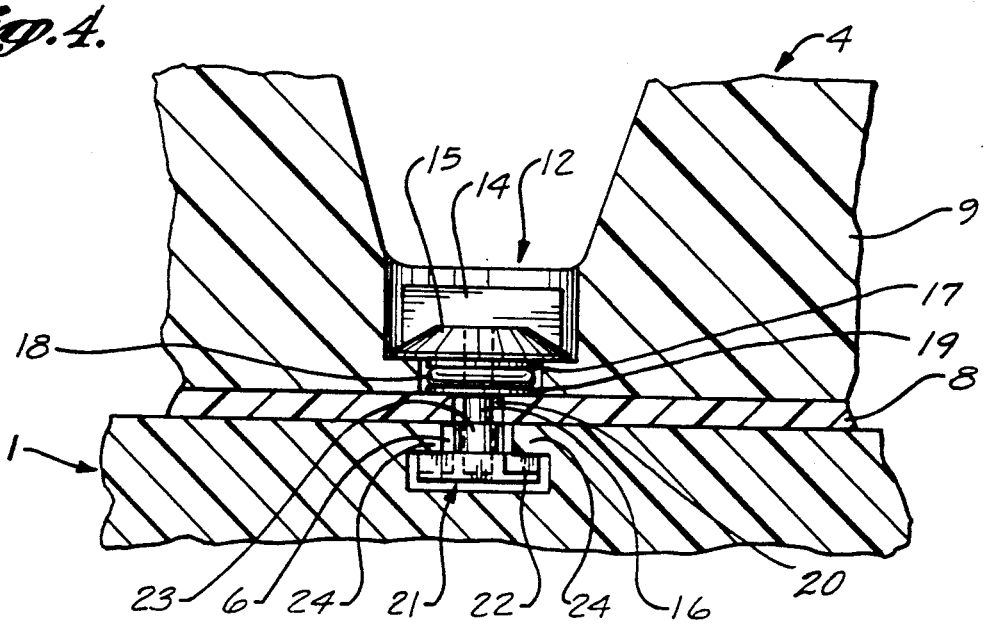
FIG. 4 is an enlarged fragmentary transverse vertical section along line 4—4 of FIG. 2.
Figure 5:
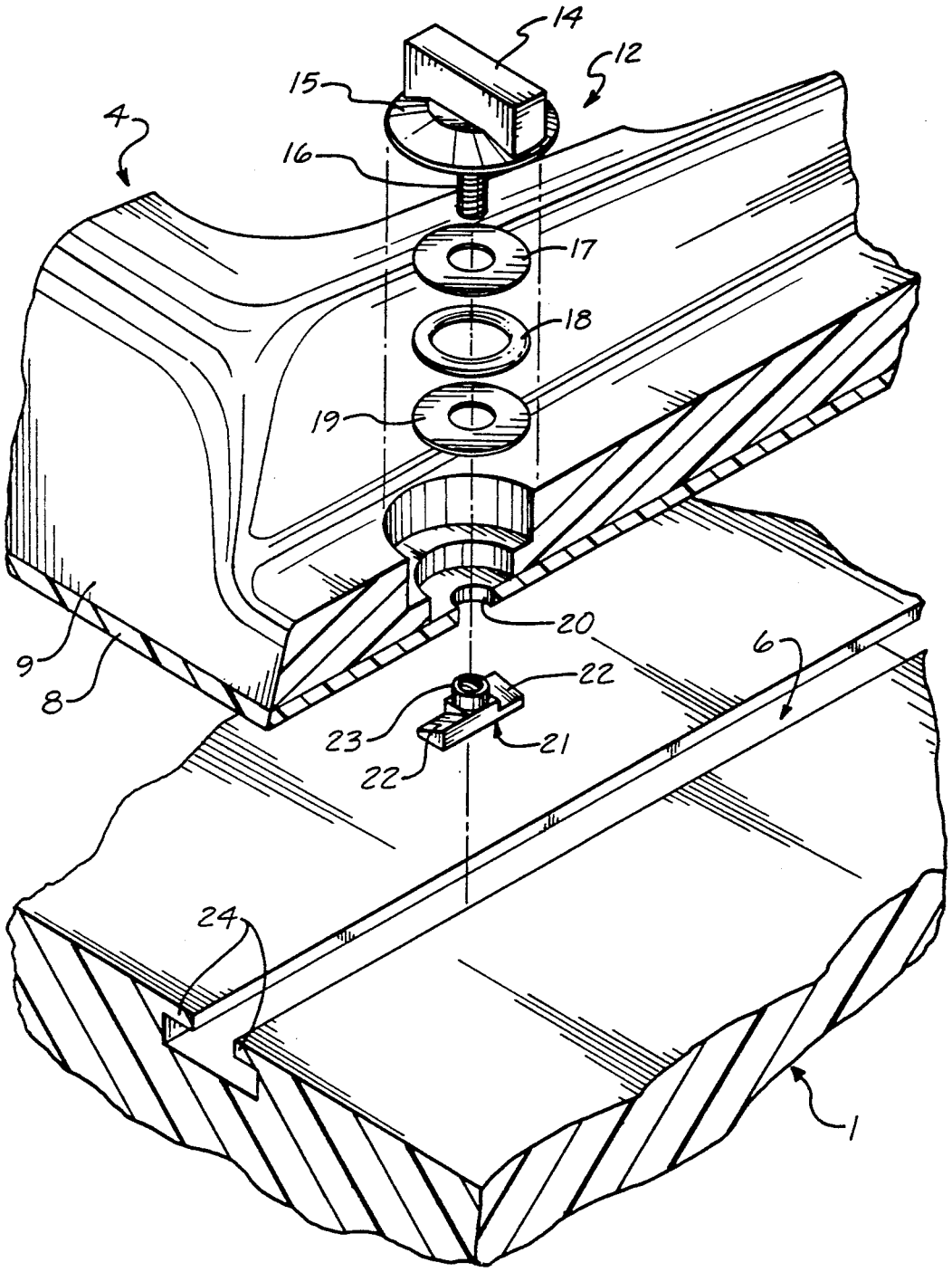
FIG. 5 is a further enlarged fragmentary perspective of a portion of a water sports board in accordance with the present invention illustrating mechanism for fastening a knee pad in position on the board, with parts shown in exploded relationship.

The construction of the rotatable front fastener 12 is shown in FIG. 4 and FIG. 5. The front fastener includes a top knob countersunk in the cushion 9 of the knee pad. The knob has a stubby handle portion 14 projecting upward from a disk 15. A threaded shank 16 projects downward from the disk through a top washer 17, a resilient snubber O-ring 18, a bottom washer 19 and a hole 20 through the baseplate 8 of the knee pad adjacent to the leading end portion of the pad and centered between the knee and shin recesses 10. A modified T nut 21 having wings 22 that are beveled or tapered oppositely is secured to the bottom of the shank 16 below the baseplate 8.

FIG. 5 illustrates the orientation of the front T nut 21 with its wings 22 extending longitudinally of the channel 6 such that the wings can pass downward into the base of the channel. The T nut includes an upper hub 23 of a diameter less than the width of the top opening of the channel and fixed on the shank 16. Turning of the handle 14 in a tightening direction, clockwise as viewed in FIG. 5, rotates the wings into the undercut portions of the channel. Due to the beveling of the top surfaces of the wings, first a vertically thin section of each wing is hooked under the inward-extending top flanges 24 of the channel, and then progressively thicker portions of the wings engage the undersides of the flanges so that the T nut is wedged downward as it is turned in the tightening direction. The effect is to clamp the snubber O-ring 18 between the washers 17 and 19 until the O-ring is substantially fully compressed and the wings extend perpendicular to the length of the channel as shown in FIG. 4. In such position, the knee pad is firmly affixed to the upper surface of the board in the condition illustrated in FIG. 2, but is quickly and easily disconnectible from the board by turning the forward rotatable fastener 12 so as to position the wings of the T nut extending longitudinally of the channel, whereupon the front of the knee pad can be raised and the pad assembly can be slid forward until the rear fastener registers with the wider channel opening 7 shown in FIG. 1.

Returning to FIG. 2, to complete the configuration of the preferred water sports board in accordance with the present invention as a kneeboard, a thigh strap 25 is secured to the board by inverted U-shaped cleats 26 positioned at opposite sides of the pad-receiving recess of the board. Such cleats form eyes 27 opening transversely of the length of the board. Strap 25 has a rectangular ring 28 at one end. The free end of the strap is first threaded through the eye of one cleat and through the ring 28 at the other end of the strap and then is threaded through the other cleat from the inside. The free end portion of the strap is folded back over itself and over the user's thighs. Preferably the free end portion 29 and central portion 30 of the strap have cooperating strips of hook and pile fastening materials for infinite adjustment of the tightness of the strap over the thighs of a user.

Figure 7:
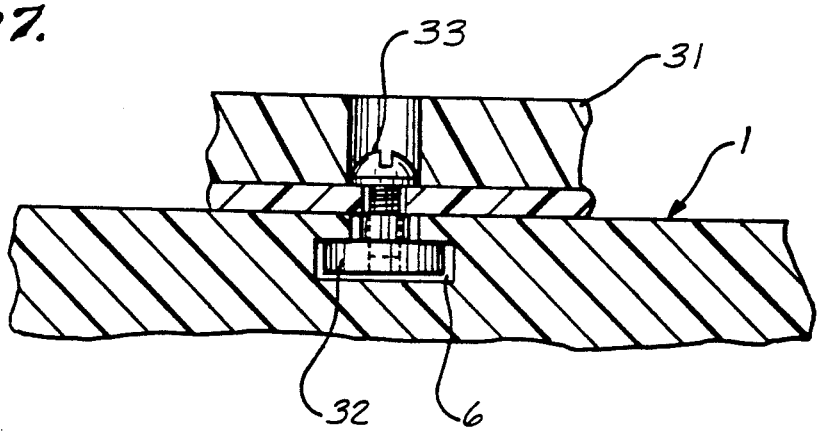
FIG. 7 (on the drawing sheet with FIGS. 3 and 4) is an enlarged transverse vertical section of a water sports board in accordance with the present invention configured as a kneeboard illustrating mechanism for fastening a foot-restraining member in position on the board.

The water sports board in accordance with the present invention also can be configured for use as a skiboard. First, strap 25 is removed by unthreading it from the cleats 26. The cleats themselves preferably are attached to the board by screws having exposed heads such that the cleats also can be removed. The knee pad is detachable as described above. The foot-restraining members can be coupled to the board in the recess 3 close to the waterline, unlike known skiboards in which the foot-restraining members are mounted over the highest surface. Preferably the foot-restraining members are bindings 5 that have rotatable mountings of the type described in co-pending U.S. patent application Ser. No. 07/810,817 referenced above. Each binding includes a circular mounting member 31 on which the remainder of the binding is rotatably mounted. As seen in FIG. 7, the mounting member 31 can be secured to the board by fasteners in the form of T nuts 32 having enlarged heads received in the base of the channel 6 and screws 33 which can be tightened to clamp the circular mounting members 31 to the upper surface of the board 1. The device in accordance with the present invention then is ready for use as a skiboard with a user in upright position, but the board can be reconfigured as a kneeboard quickly and easily.

While the preferred embodiment of the invention has been illustrated and described, it will be appreciated that various changes can be made therein without departing from the spirit and scope of the invention.

The embodiments of the invention in which an exclusive property or privilege is claimed are as follows:

1. An aquatic sports device for supporting a user towed behind a boat comprising a water-skimming baseboard having a bottom surface and a top surface, a knee pad separate from said board adapted to support the user in kneeling position, and means for fastening said knee pad to said upper surface of said board for support of a user thereon, said fastening means including means enabling said knee pad to be detached from said board for use of said board without said knee pad, said fastening means including a channel in the upper surface of said board and a mechanical fastener carried by said knee pad and fittable in said channel for mechanically and detachably connecting said knee pad to said board.

2. The sports device defined in claim 1, in which the upper surface of the board has an upward-extending ridge defining a recess, the knee pad being fittable in said recess and being detachably connectible therein by the fastening means.

3. The sports device defined in claim 2, in which the knee pad includes a substantially rigid bottom baseplate of substantially the same outline shape as the recess for close fitting in the recess and an upper cushion of material more resilient than said substantially rigid baseplate which cushion is secured to the baseplate.

4. An aquatic sports kit for configuration as a kneeboard or a skiboard comprising a water-skimming baseboard having a bottom surface and a top surface, a knee pad separate from said board adapted to support a user in a kneeling position, said knee pad and said board having cooperating fastening means for detachably connecting said knee pad to said board, and at least one foot-restraining member, said foot-restraining member and said board having cooperating fastening means for detachably connecting said foot-restraining member to said board, when said knee pad is disconnected, for supporting a user standing on said board with a foot received in the foot-restraining member, said knee pad fastening means including a first fastener carried by said knee pad, said foot-restraining member fastening means including a second fastener carried by said foot-restraining member, and said board fastening means including fastening mechanism cooperable with both said first and second fasteners for optionally connecting said knee pad to said board to configure the kit for use as a kneeboard or said foot-restraining member to said board to configure the kit for use as a skiboard.

5. The aquatic sports kit defined in claim 4, in which the upper surface of the board includes an upward-extending ridge defining a recess, the knee pad being closely fittable in said recess.

6. The aquatic sports device defined in claim 5, in which the board fastening mechanism is located in the recess.

7. The aquatic sports board defined in claim 5, in which the knee pad includes a substantially rigid baseplate closely fittable in the recess for engagement against the upper surface of the board and an upper resilient cushion secured to said baseplate.

8. An aquatic sports device for supporting a user towed behind a boat comprising a water-skimming baseboard having a bottom surface and a top surface, a knee pad separate from said board adapted to support the user in kneeling position, and means for fastening said knee pad to said upper surface of said board for support of a user thereon, said fastening means including means enabling said knee pad to be detached from said board for use of said board without said knee pad, said upper surface of said board having an upward-extending ridge defining a recess, said knee pad being fittable in said recess and being detachably connectible therein by said fastening means, said knee pad including a substantially rigid bottom baseplate of substantially the same outline shape as said recess for close fitting in said recess and an upper cushion of material more resilient than said substantially rigid baseplate which cushion is secured to said baseplate.

9. An aquatic sports kit for configuration as a kneeboard or a skiboard comprising a water-skimming baseboard having a bottom surface and a top surface, a knee pad separate from said board adapted to support a user in kneeling position, said knee pad and said board having cooperating fastening means for detachably connecting said knee pad to said board, and at least one foot-restraining member, said foot-restraining member and said board having cooperating fastening means for detachably connecting said foot-restraining member to said board, when said knee pad is disconnected, for supporting a user standing on said board with a foot received in the foot-restraining member, the upper surface of said board including an upward-extending ridge defining a recess, said knee pad being closely fittable in said recess, and the board fastening mechanism being located in said recess.

10. An aquatic sports kit for configuration as a knee board or a skidboard comprising a water-skimming baseboard having a bottom surface and a top surface, a knee pad separate from said board adapted to support a user in kneeling position, said knee pad and said board having cooperating fastening means for detachably connecting said knee pad to said board, and at least one foot-restraining member, said foot-restraining member and said board having cooperating fastening means for detachably connecting said foot-restraining member to said board, when said knee pad is disconnected, for supporting a user standing on said board with a foot received in the foot-restraining member, the upper surface of said board including an upward-extending ridge defining a recess, the knee pad being closely fittable in said recess, said knee pad including a substantially rigid baseplate closely fittable in said recess for engagement against the upper surface of said board and an upper cushion of material more resilient than said substantially rigid baseplate which cushion is secured to said baseplate.

* * * * *

UNITED STATES PATENT AND TRADEMARK OFFICE

CERTIFICATE OF CORRECTION

PATENT NO. : 5,257,953

DATED : November 2, 1993

INVENTOR(S) : D. B. Gillis

It is certified that error appears in the above-indentified patent and that said Letters Patent is hereby corrected as shown below:

On the title page, item:

[56] 2nd Ref. "U.S. Patents" Please add --D290,151 06/1987 Cashmere--

[56] 3rd Ref. "U.S. Patents" Please add --4,020,782 05/1977 Gleason--

[56] 4th Ref. "U.S. Patents" Please add --4,619,619 10/1986 Muse, Jr.--

[56] 5th Ref. "U.S. Patents" Please add --4,629,434 12/1986 Monreal--

[56] 6th Ref. "U.S. Patents" Please add --4,857,025 08/1989 Brown et al.--

Signed and Sealed this

Fifth Day of April, 1994

Bruce Lehman

*Attest:*

BRUCE LEHMAN

*Attesting Officer*

*Commissioner of Patents and Trademarks*